US012325967B2

(12) United States Patent
Chalmers

(10) Patent No.: US 12,325,967 B2
(45) Date of Patent: Jun. 10, 2025

(54) ADJUSTABLE SNOW PLOW BLADE

(71) Applicant: Steven Chalmers, Castle Rock, CO (US)

(72) Inventor: Steven Chalmers, Castle Rock, CO (US)

( * ) Notice: Subject to any disclaimer, the term of this patent is extended or adjusted under 35 U.S.C. 154(b) by 879 days.

(21) Appl. No.: 17/387,137

(22) Filed: Jul. 28, 2021

(65) Prior Publication Data

US 2022/0034056 A1 Feb. 3, 2022

Related U.S. Application Data

(60) Provisional application No. 63/059,391, filed on Jul. 31, 2020.

(51) Int. Cl.
*E01H 5/06* (2006.01)
*E01H 5/04* (2006.01)

(52) U.S. Cl.
CPC ..... *E01H 5/061* (2013.01); *E01H 5/066* (2013.01)

(58) Field of Classification Search
CPC .. E01H 5/04; E01H 5/06; E01H 5/061; E01H 5/066; E01H 5/067
See application file for complete search history.

(56) References Cited

U.S. PATENT DOCUMENTS 3,353,287 A * 11/1967 King ..... E02F 3/7613 37/283
6,050,008 A * 4/2000 Doornek ..... E01H 5/066 37/231
2007/0101620 A1* 5/2007 Roy ..... E01H 5/06 37/232
2016/0312422 A1* 10/2016 Boumediene ..... E01H 5/06

* cited by examiner

*Primary Examiner* — Christopher J Sebesta
*Assistant Examiner* — Robert E Pezzuto
(74) *Attorney, Agent, or Firm* — Edwin H. Crabtree

(57) ABSTRACT

An adjustable snow plow blade mechanism connected to a front end loader (FEL). The FEL mounted in front of a tractor. In one embodiment, the plow blade mechanism includes a control plate with three blade control points. The control plate is adapted for attachment to a rear of a snow plow blade. A control arm is pivotally attached to the control plate. The control arm can be moved from one blade control point to another for adjusting a snow plow blade angle. An opposite end of the control arm is pivotally attached to a front of an attachment plate. The attachment plate is adapted for mounting on the FEL. The attachment plate is raised and tilted by the FEL. The attachment plate, the control arm and the control plate are used for moving the snow plow blade to a left blade position, or to a right blade position, or to a neutral and straight ahead blade position on a roadway.

7 Claims, 14 Drawing Sheets

ADJUSTABLE SNOW PLOW BLADE

BACKGROUND OF THE INVENTION

(a) Field of the Invention

This invention relates to an adjustable snow plow blade mounted in front of a front end loader (FEL) and more particularly, but not by way of limitation, to 3 mechanisms that allow the FEL operator to change an angle of the snow plow blade through the use of tilting the FEL.

(b) Discussion of Prior Art

When plowing snow and other movable objects, it is useful for the FEL to position a snow plow blade angle to the right, to the left or straight ahead. Currently, FEL's can angle the snow plow blade to the right, to the left or straight ahead using hydraulics or a manual adjustment. The implementing of hydraulic controls is an expensive addition to the FEL. The manual adjustment of the blade angle requires lifting of the FEL arms, dismounting the tractor, removing a rotation locking pin from the blade, manually rotating the blade, and replacing the rotation locking pin. This type of manual adjustment is time consuming.

The subject invention eliminates the manual removal and reinserting of the manually operated blade rotation locking pin, thus providing for quick and convenient adjustment of the angle of the snow plow blade and eliminates the need for auxiliary hydraulics at the front of the tractor.

SUMMARY OF THE INVENTION

In view of the foregoing, it is a primary objective of the subject invention to provide an easy way to operate the adjustment of a snow plow blade angle using the tilting action of the FEL.

These and other objects of the present invention will become apparent to those familiar with operation of a snow plow blade used with a FEL mounted to a tractor when reviewing the following detailed description and drawings of the invention, showing novel construction and a combination of structural elements as described herein.

BRIEF DESCRIPTION OF THE DRAWINGS

The accompanying drawings illustrate complete preferred embodiments in the present invention according to the best modes presently devised for the practical application of the snow plow blade with control plate and control arm and in which.

DETAILED DESCRIPTION OF THE PREFERRED EMBODIMENTS

Figure 1:
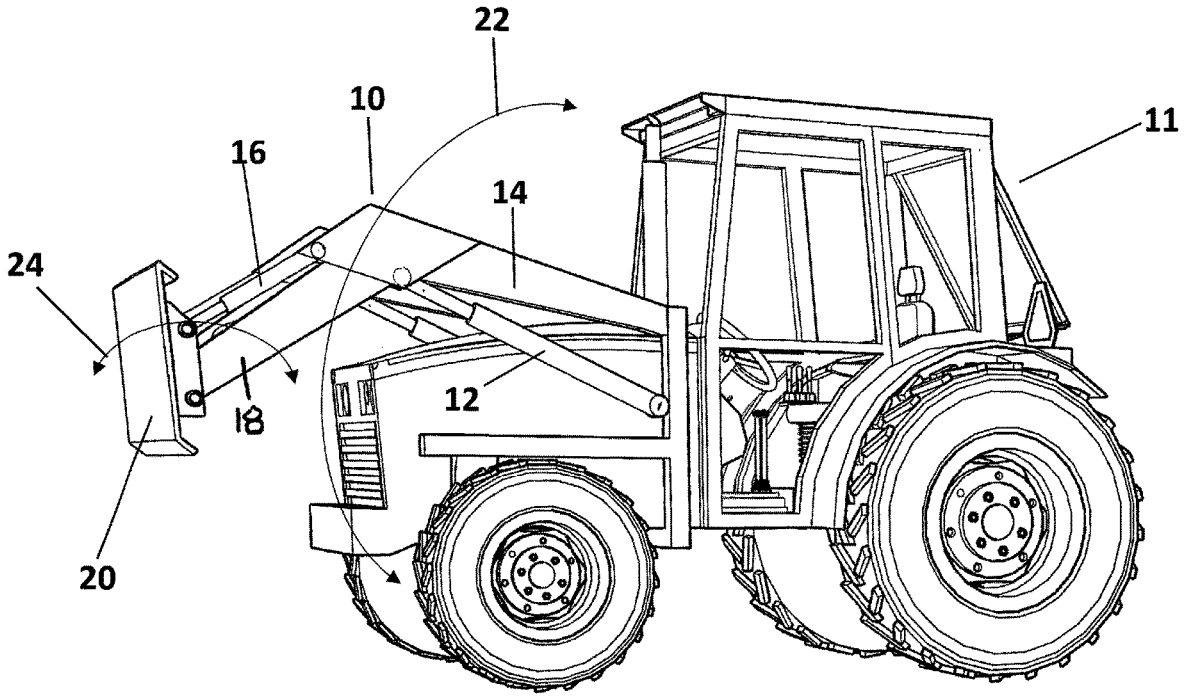
FIG. 1 is a perspective view of the FEL with lift hydraulic cylinder, tilt hydraulic cylinder and quick attachment plate.

In FIG. 1, a perspective view of a FEL is shown having general reference numeral 10, mounted on a tractor 11. The FEL includes lift hydraulic cylinder 12 and a tilt hydraulic cylinder 16 connected to a lift arm 14. The tilt hydraulic cylinder 16 is attached to a rear of a quick attachment plate 20. Arrow 22 indicates the lifting of the attachment plate 20. The use of the tilting of the attachment plate in the subject invention is important when changing a snow blade from left, to center and to right. The above features of the FEL 10 are standard equipment for this type of tractor.

Figure 11:
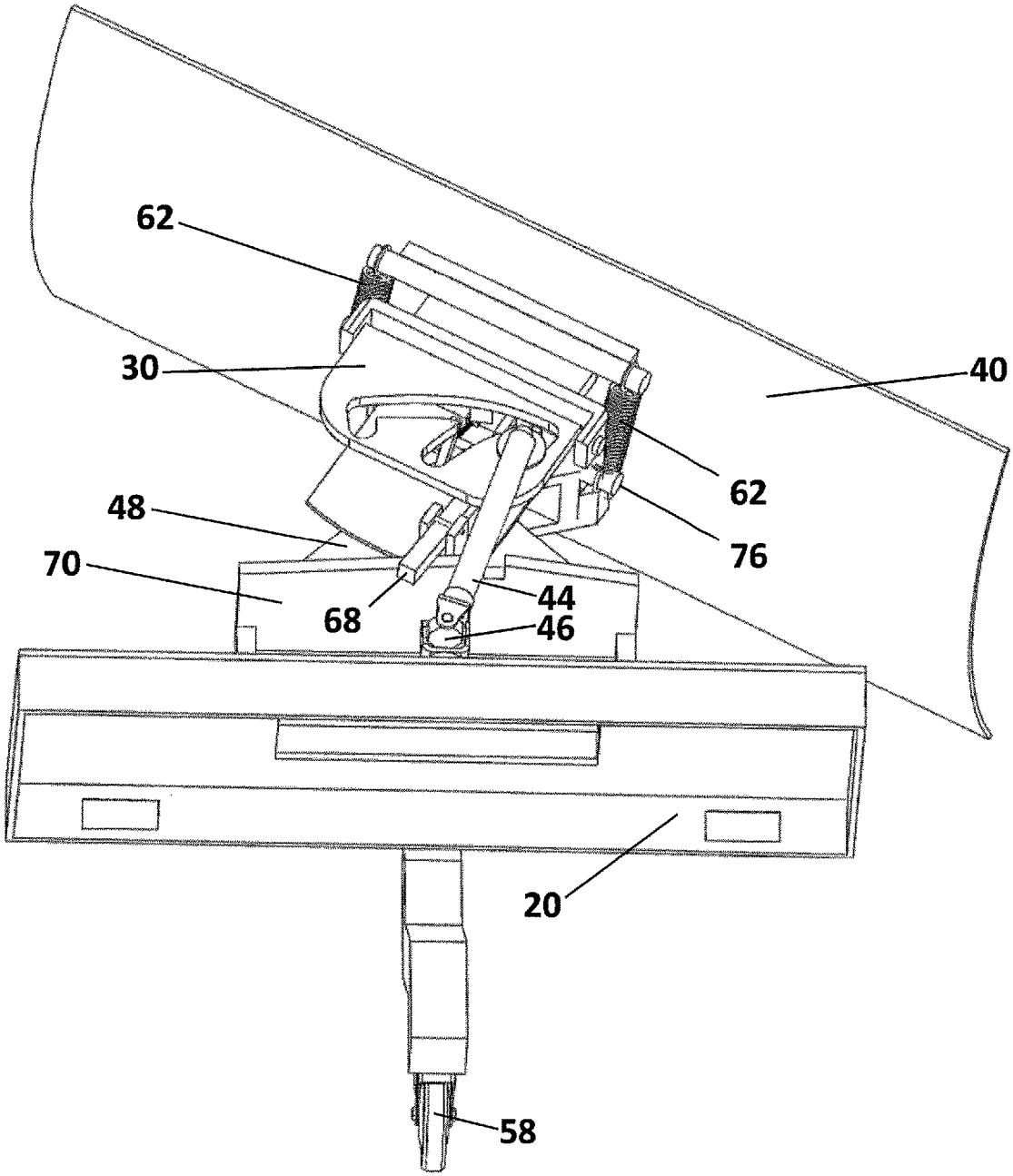
FIG. 11 is a top perspective view of the snow plow blade, control plate, control arm, and attachment plate in the right hand plowing position.

The FEL 10 lift hydraulic cylinder 12 must be placed in a "float" mode for the operation of the subject invention. In the float mode, which is common to FELs, the lift cylinder 12 does not affect the lift arm 14. This invention creates a pivot point that does not move relative to the ground when the FEL is tilted. This is made possible by placing the lift arm 14 in the float mode, resting the FEL lift arm 14 on a frame 48, which in turn rests on a snow plow blade 40 and a tailwheel 58. The snow plow blade 40 and the tailwheel 58 are shown in FIG. 11.

Figure 2:
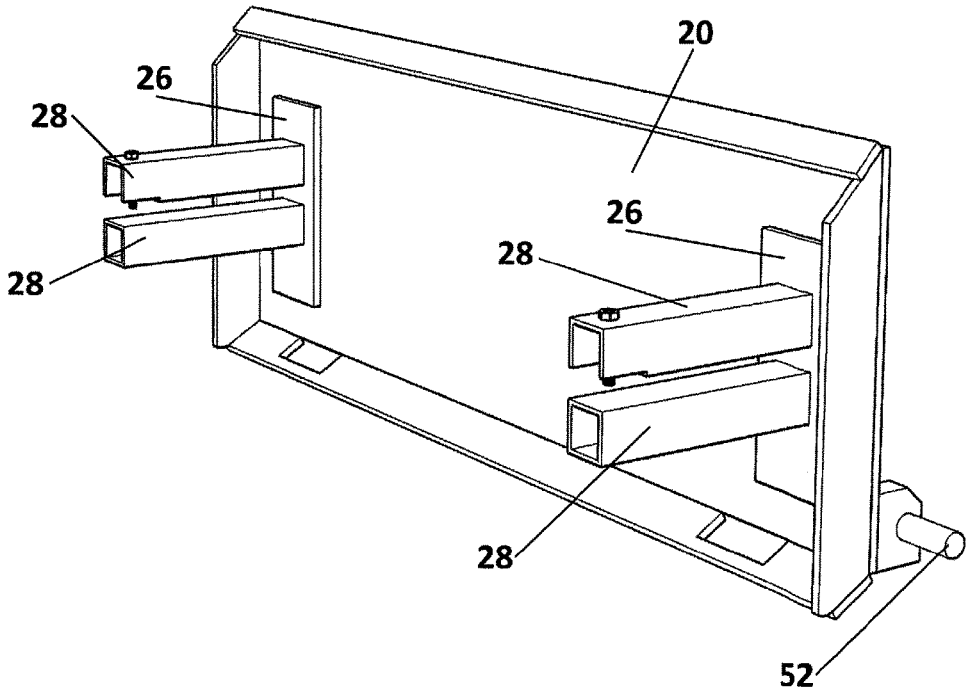
FIG. 2 is a perspective view of a pair of clamps attached to a rear of the attachment plate and used for mounting on the front of the FEL.

In FIG. 2, a perspective view of a pair of clamps 26 are shown with spaced apart clamp arms 28 attached to a rear of the attachment plate 20. The clamps 26 can be used for mounting on a lip of a front of a bucket mounted on the front of the FEL. The bucket is not shown in the drawings.

Figure 3:
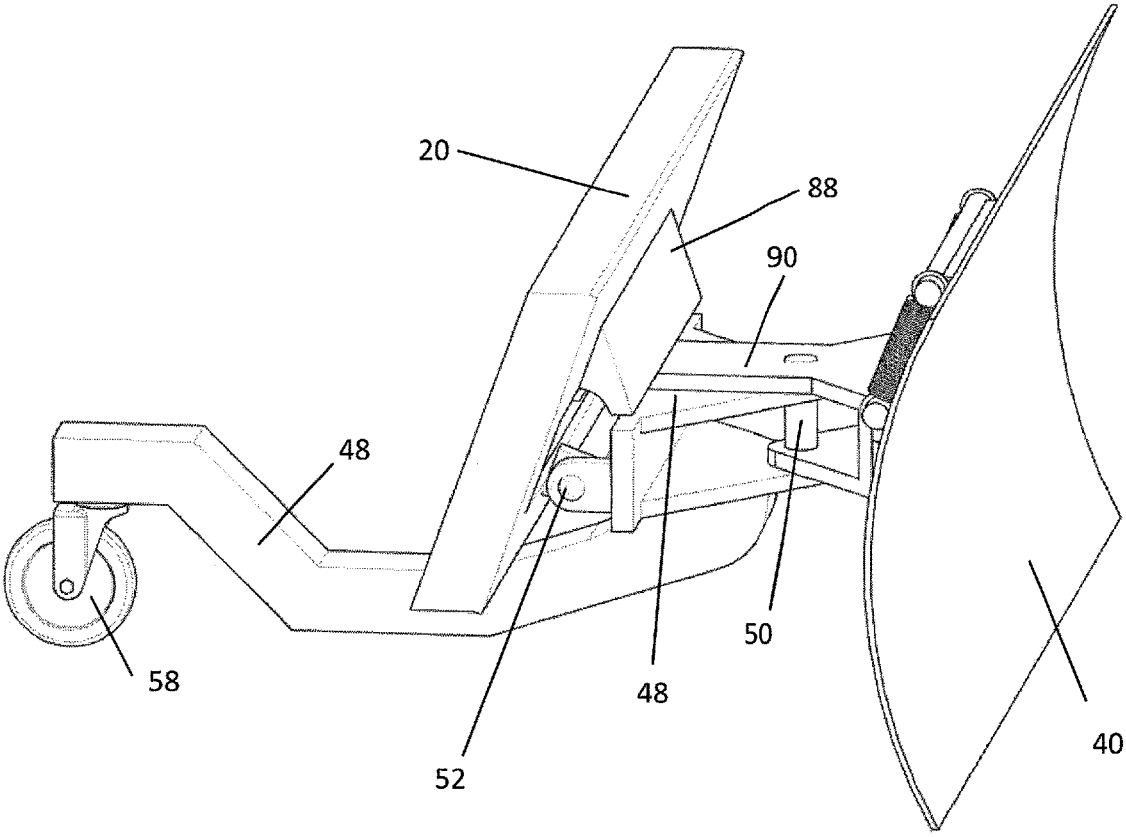
FIG. 3 is a perspective view of a pinch mechanism used in securing a plow angle on a snow plow blade.

Design Option 1:

In FIG. 3, the FEL has tilted the quick attachment plate 20 forward, pinching a pinch bar 90 between a pinch block 88 and a plow frame 48, restricting the pivoting of the snow plow blade 40.

The pinch block 88 locks and unlocks the pivoting of the blade 40 using the tilt function of the FEL. When tilted forward on a horizontal attachment plate rod 52, the pinch block 88, mounted to the attachment plate 20, clamps the pinch bar 90, a fixed element of blade 40, against the plow blade frame 48. This feature locks the pivoting of the blade 40. With the FEL tilted NRK OFFI back, the pinch block 88 is no longer engaging the pinch bar 90 and the blade 40 is free to be pivoted on a vertical pivot rod 50.

To pivot the blade 40, the operator releases the pinch by tilting the attachment plate backward, then uses the motion of the tractor, moving forward or backward, steering left or right, to affect the angle of the blade 40. Because the blade 40 rests on the ground and thus resists movement, it is a simple matter to change the angle of the blade 40 relative to the tractor either by steering the tractor while moving or by pushing against a pile of snow, or other object, with the blade 40 to turn it.

Figure 4:
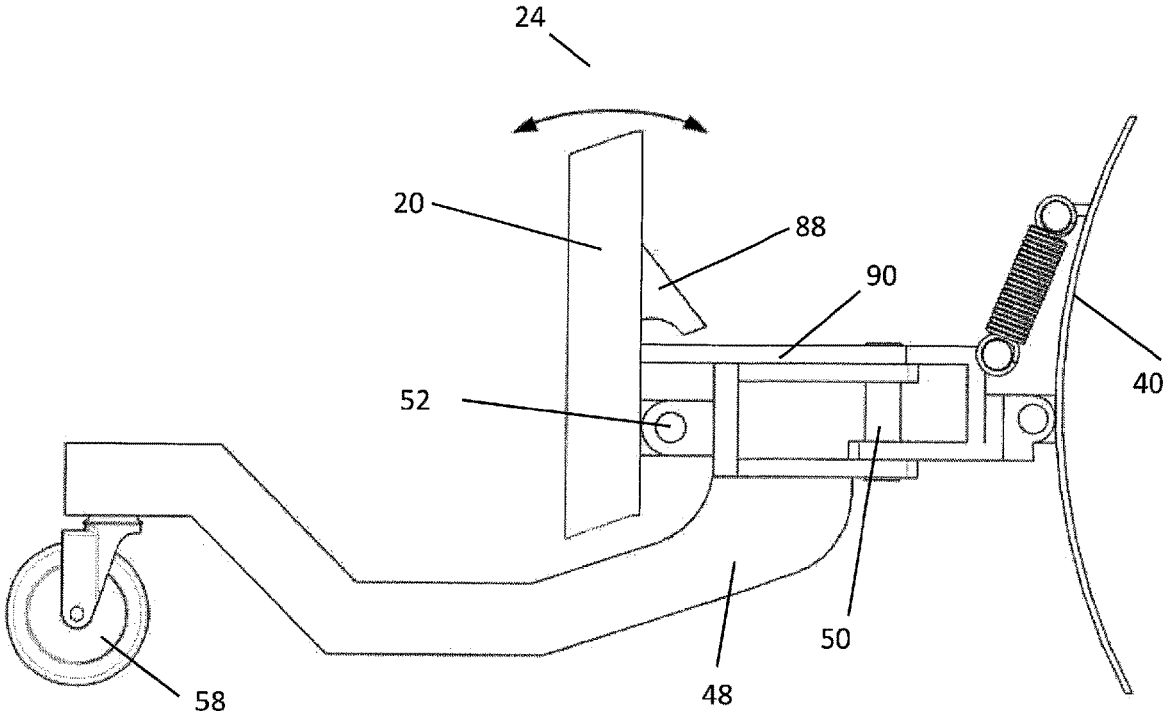
FIG. 4 is a side view of the pinch mechanism shown in FIG. 3.

In FIG. 4, the FEL has tilted the quick attachment plate 20 backward to free the pinch bar 90 from the pinching action of the pinch block 88. In this state, the blade 40 is free to pivot.

Figure 5:
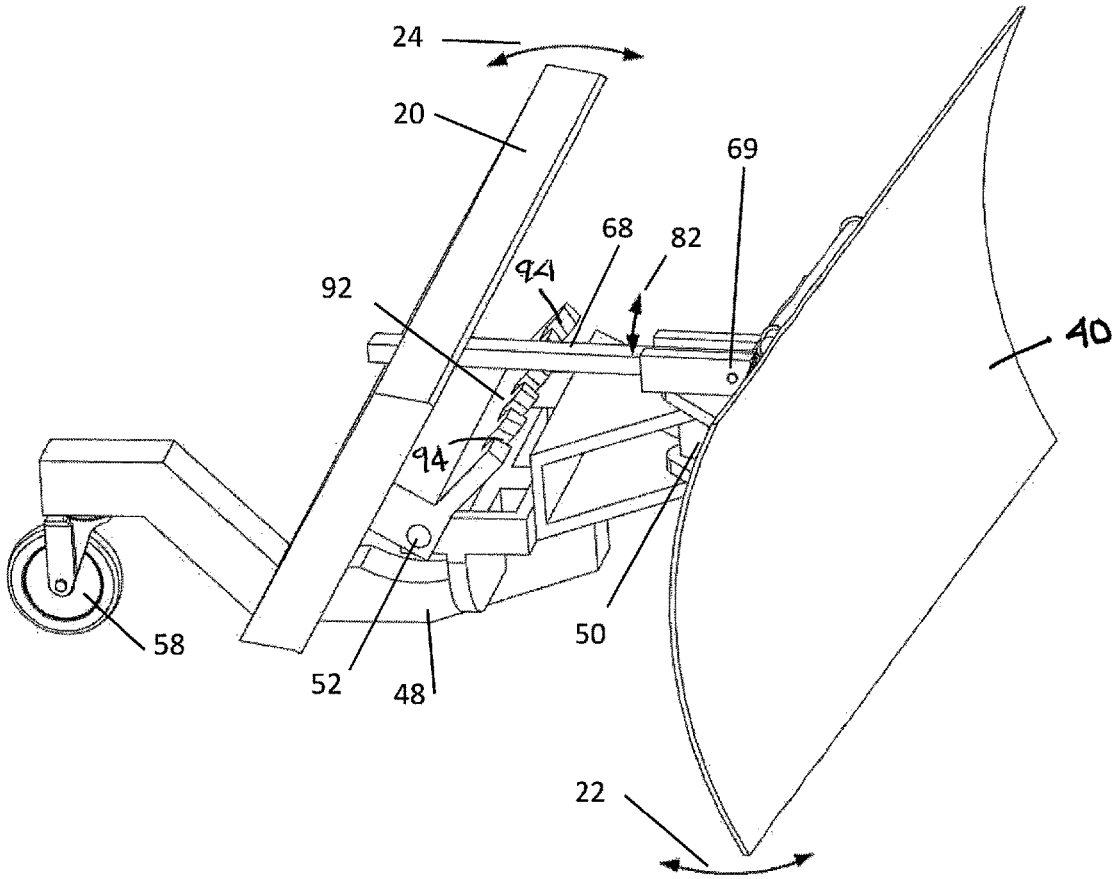
FIG. 5 is a perspective view of a lock notch bar with lock notches used to engage and disengage the snow plow blade.

Design Option 2:

In FIG. 5, the FEL has tilted the attachment plate 20 forward and a lock notch bar 92, with lock notches 94, has dropped below a lock bar 68, freeing the blade 40 to rotate. The lock bar 68 is limited in its downward movement by its mounting and its pivot pin 69. To affect the angle of the blade 40 as desired, the operator will either drive the tractor backward or forward, steering left or right. Once the desired blade angle has been achieved, the operator will tilt the quick attachment plate 20 backward to secure the blade angle.

Figure 6:
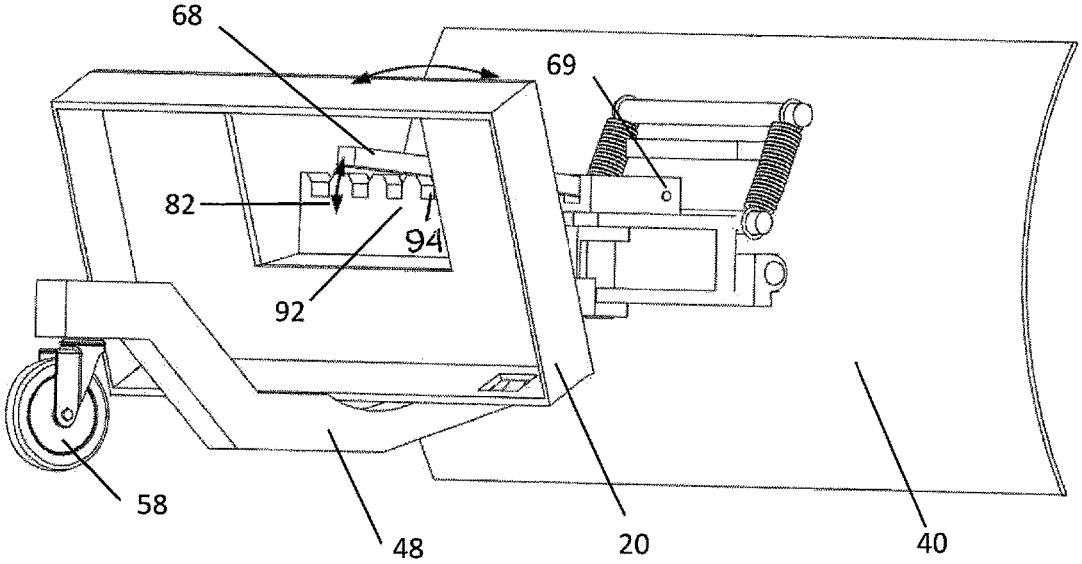
FIG. 6 is a perspective view of the lock notch activated but awaiting the lock bar to settle in a lock notch.

In FIG. 6, the quick attachment plate 20 is rotated back. A tip of the lock notches 94 have lifted the lock bar 68, see motion arrow 82, because the lock bar 68 is not align with one of the lock notches 94. As the blade 40 freely moves to the left or right, the lock bar 68 will eventually find one of the lock notches 94 to fall into and will lock the blade 40 to that angle.

Figure 7:
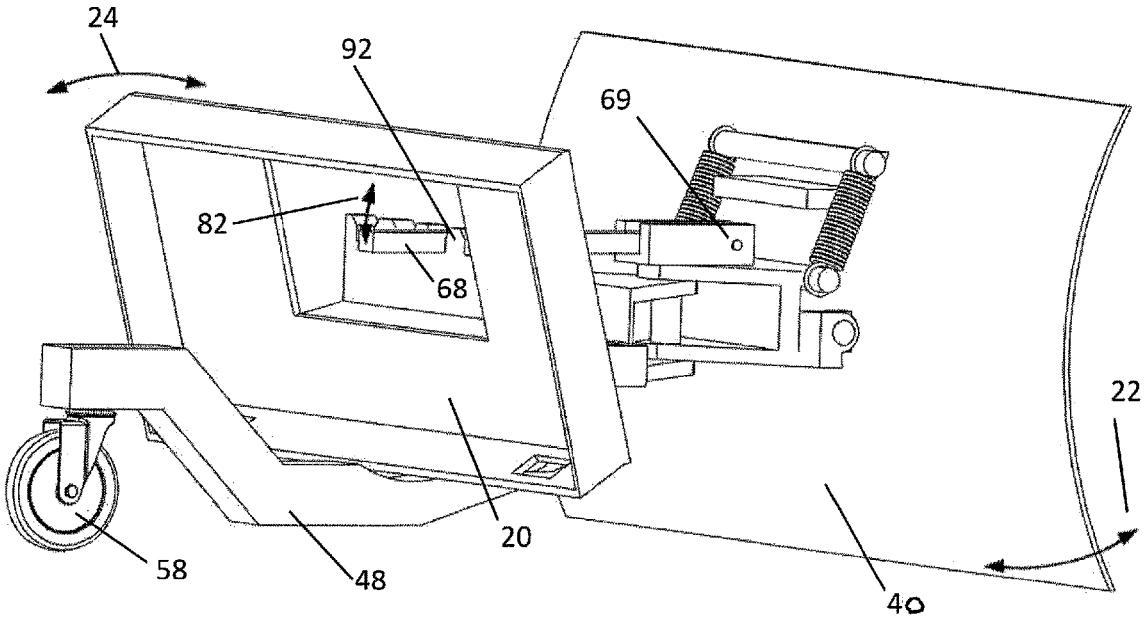
FIG. 7 is a perspective view of the lock notch fully engaged.

In FIG. 7 the attachment plate 20 is tilted backward and the lock bar 68 has settled into one of the lock notches 94 securing the blade 40 angle.

Figure 8:
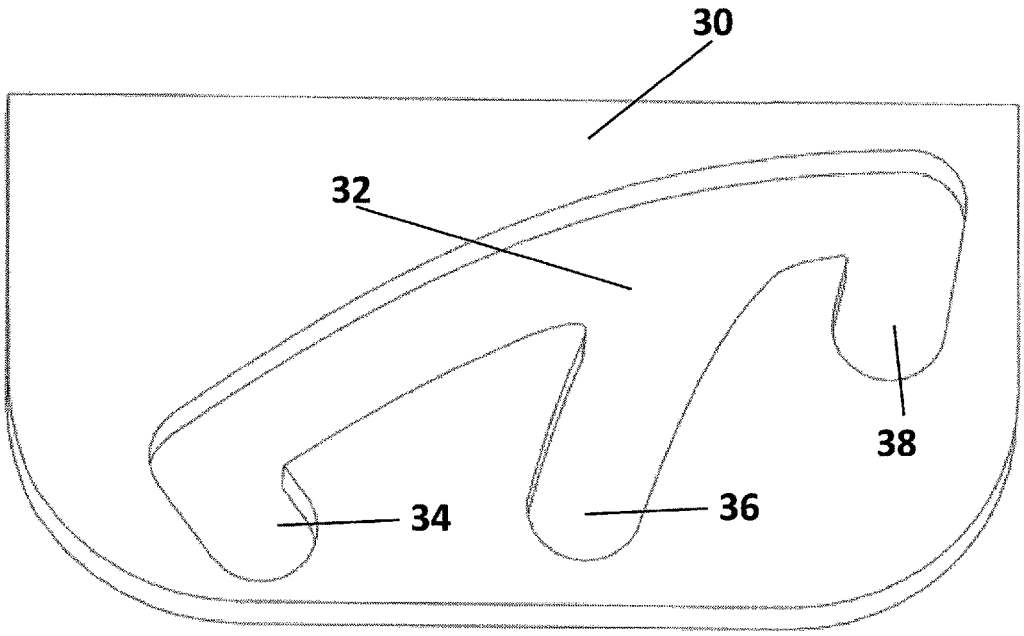
FIG. 8 is a perspective view of the control plate with control points.

Design Option 3:

In FIG. 8, a perspective view of a control plate 30 is shown with a semi-circular channel 32 along a length of the plate. The control plate 30 includes a left hand plowing control point 34, a straight ahead plowing control point 36 and a right hand plowing control point 38.

Figure 9:
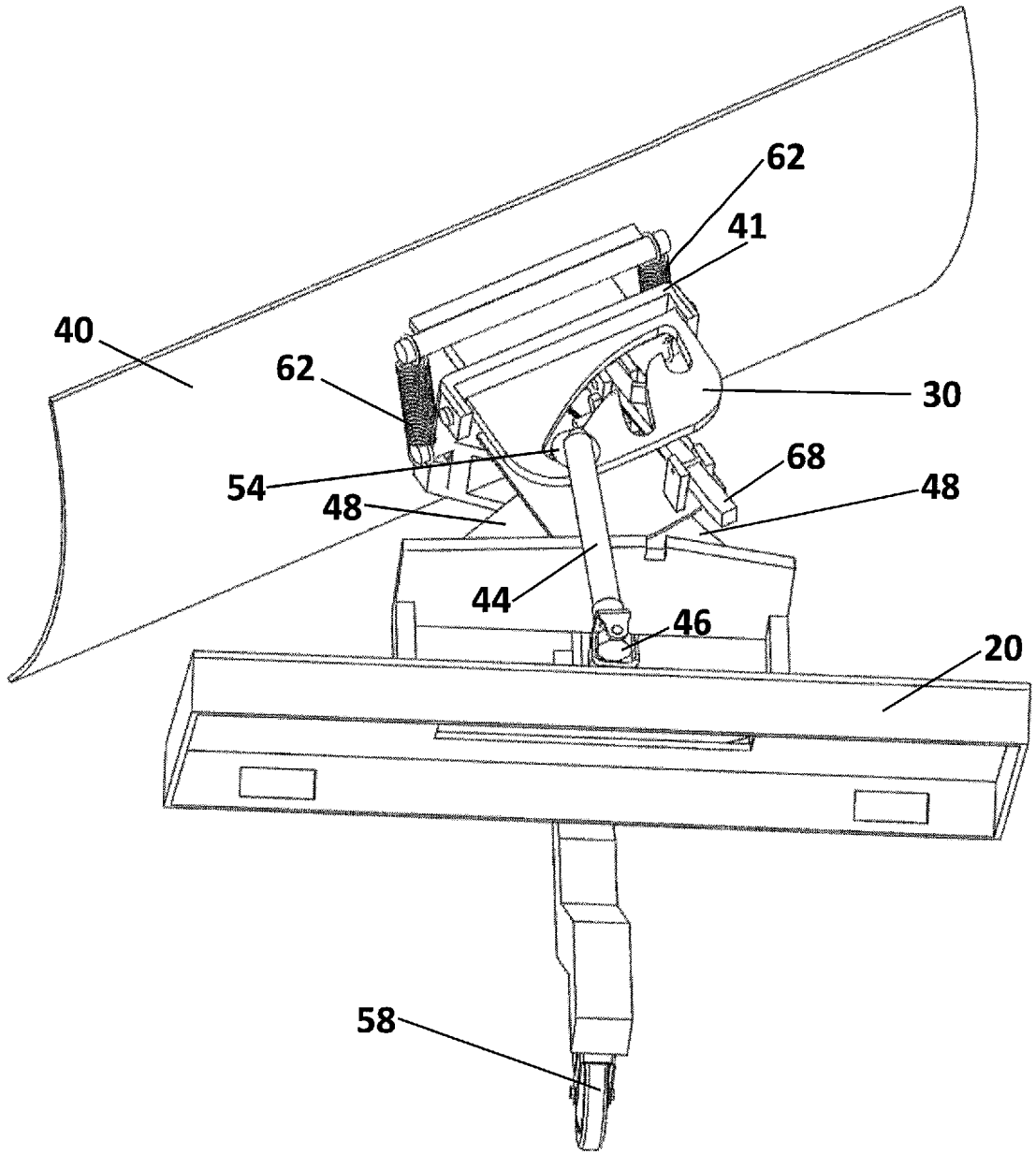
FIG. 9 is top perspective view of the snow plow blade, control plate, control arm, and attachment plate in a left hand plowing position.
Figure 13:
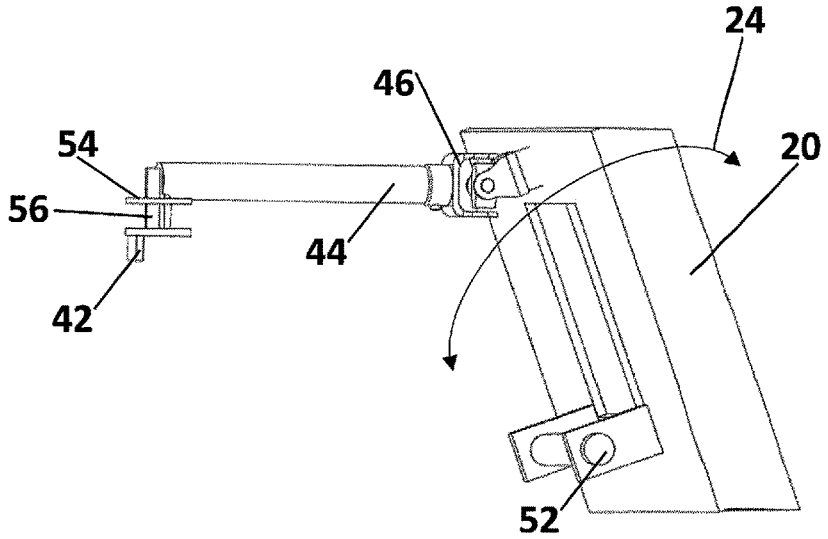
FIG. 13 is a perspective view of the control arm and a U joint attached to the attachment plate.

In FIG. 9, a top perspective view of a snow plow blade 40 is shown and pivotally mounted to the frame 48. The control plate 30 is shown pivotally mounted to the snow plow blade 40 using a "U" shaped bracket 41. In this drawing, the snow plow blade 40 is shown in a left plowing position. The attachment plate 20 is tilted backward. A control pin 42 is connected to one end of a control arm 44. The control point 42 is shown in FIG. 13. An opposite end of the control arm 44 is attached to a U joint 46. The U joint 46 is attached to a front of the attachment plate 20. The control pin 42 is engaged with the control point 34.

Figure 10:
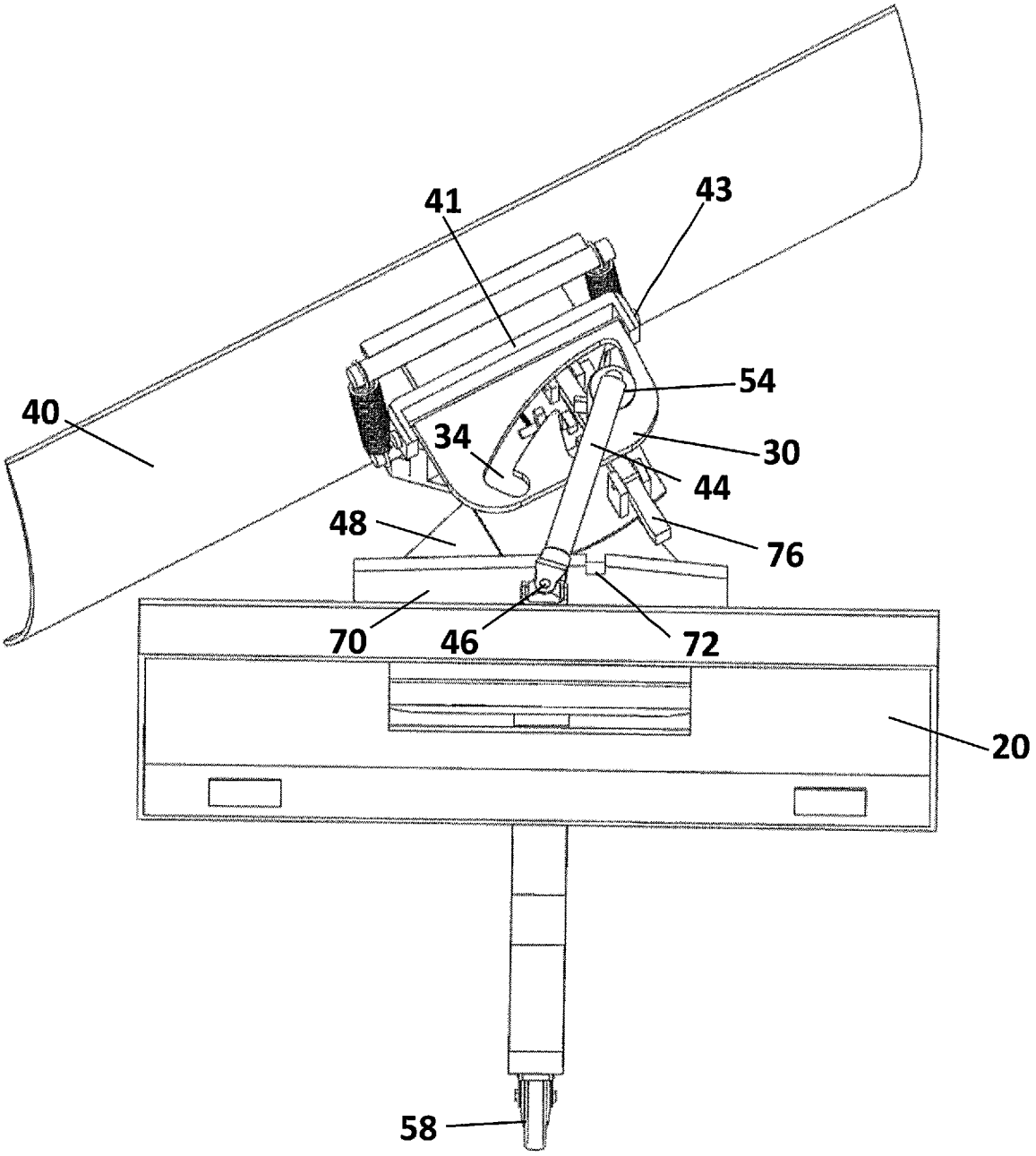
FIG. 10 is a top perspective view of the snow plow blade, control plate, control arm, and attachment plate in a left hand plowing position being readied for transition to a right hand plowing position.

In FIG. 10, the attachment plate is tilted forward driving the control pin 42 toward control point 38. Once the control point 38 is engaged, the operator will tilt the attachment plate 20 backwards to pull the snow plow blade 40 to the right plowing position.

In FIG. 11, the attachment plate 20 is tilted backward pulling the control arm 44, which in turn pivots the snow plow blade 40 on the vertical pivot rod 50 to the right plowing position. It should be noted, trip springs 62 and a trip pivot point 76 are shown only to demonstrate that a common design of a trip mechanism is not encumbered by the tilt plow design presented herein.

Figure 12:
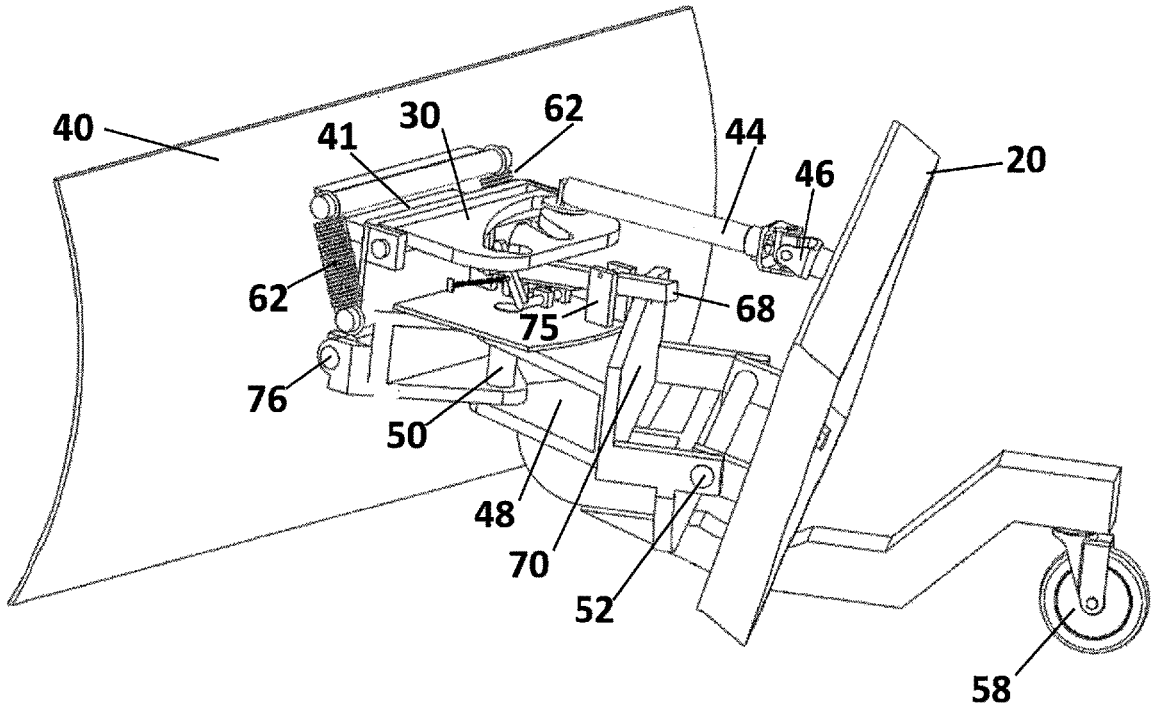
FIG. 12 is a perspective view of the snow plow blade, shown in FIG. 9.

In FIG. 12, a perspective view of the snow plow blade 40 is shown attached to one end of a tail wheel frame 48 with a vertical pivot rod 50. The plow blade frame 48 is pivotally mounted to the attachment plate 20 with a horizontal attachment plate rod 52. An opposite end of the tail wheel frame 48 is mounted on a tail wheel 58. The vertical control pin 42 is shown received in the right hand control point 38 having rotated the blade 40 to the right. In this drawing and in FIG. 11, the blade 40, when moving forward, will move the snow to the right of a plowed surface. The tail wheel 58 is used to support a trailing end of the tail wheel frame 48.

In FIG. 13, a perspective view of the control arm 44 is shown attached to the U joint 46. The U joint 46 is shown attached to a portion of the attachment plate 20. The vertical control pin 42 includes a pin cap 54 and a pin bearing 56. The pin bearing 56 rides inside the channel 32, when the control pin 42 moves to the three control points 34, 36, and 38 on the control plate 30.

Figure 14:
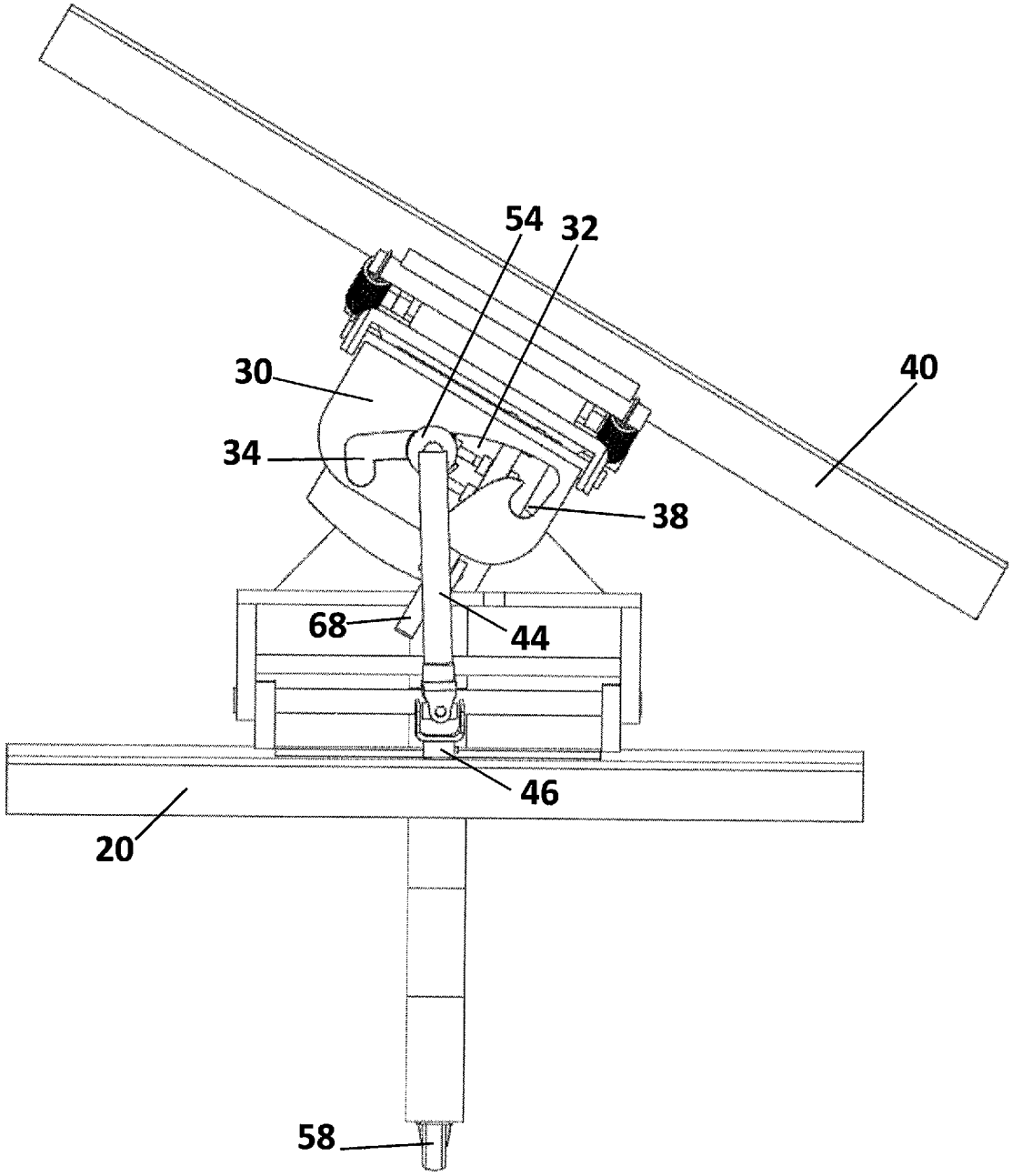
FIG. 14 is a top perspective view of the snow plow blade, control plate, control arm, and attachment plate in a right hand plowing position being readied for the left hand plowing position.

In FIG. 14, when the snow plow blade 40 is in the right plowing position, and the attachment plate 20 is tilted forward and away from the FEL operator, the control arm 44, as shown, is pushed forward, moving the control pin 42 away from the engaged control point 38, to either the opposite end of the channel 32 to the left hand control point 34, or the straight ahead control point 36, depending on the amount the attachment plate 20 is tilted forward. If the FEL operator has tilted the attachment plate 20 such that the control arm pin bearing 56 has travelled the full length of the channel 32 and has engaged control point 34, tilting the attachment plate 20 backward toward the FEL operator, the snow plow blade 40 will move to the left plowing position. If instead, the FEL operator tilts the attachment plate 20 to move the control arm pin bearing 56 to the center of the channel 32, then tilting the attachment plate 20 backward toward the FEL operator will pull the control pin 42 toward the control point 36. With the control pin 42 engaged with control point 36, tilting the attachment plate 20 further backward will turn the snow plow blade 40 to a center or a straight ahead plowing position.

When the snow plow blade 40 is in the straight ahead plowing position, and the attachment plate 20 is then tilted forward away from the FEL operator, the control arm pin bearing 56 will follow the channel 32 toward the right ahead control point 38. If the attachment plate 20 is then tilted backward toward the FEL operator, the mechanical linkage of the control arm 44 rotates the snow plow blade 40 to the right plowing position.

Figure 15:
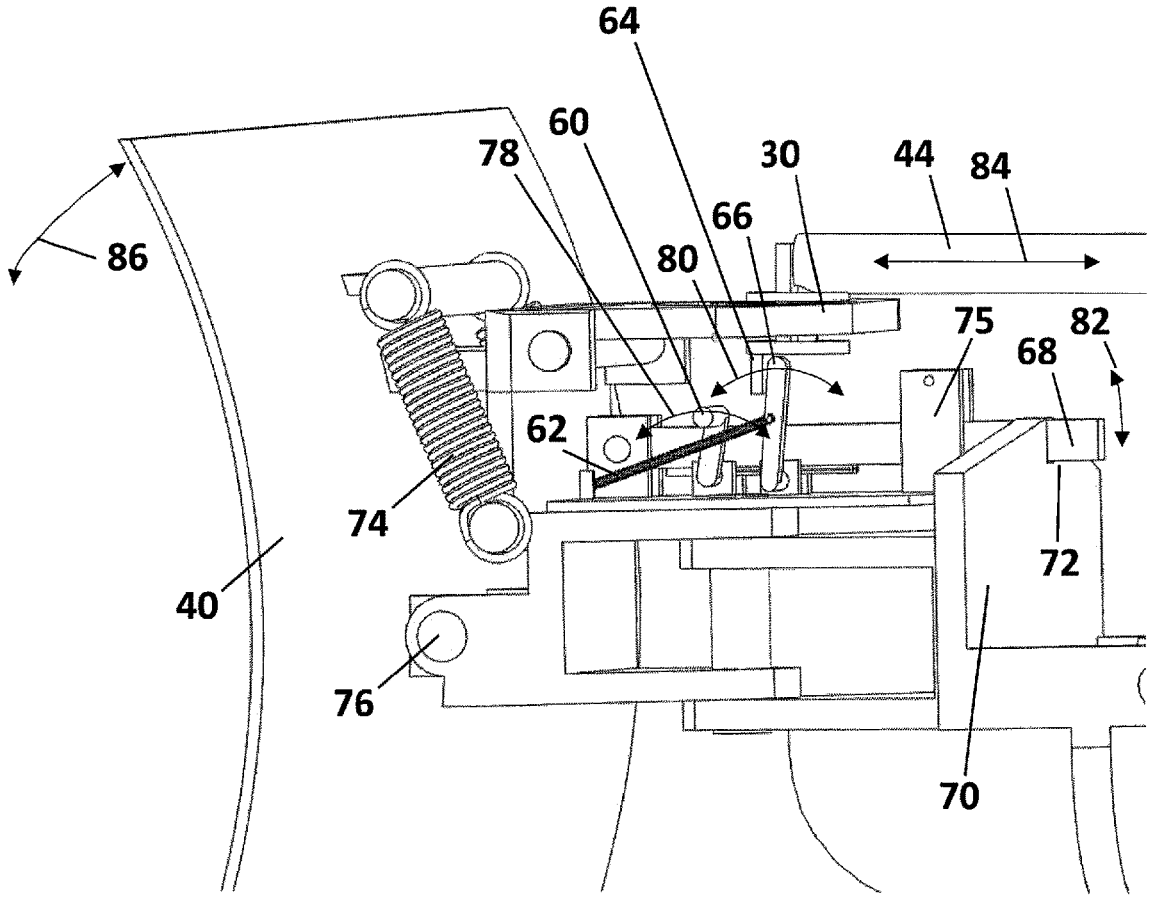
FIG. 15 is a perspective view of a straight ahead plowing position locking mechanism, showing a lock bar engaged in a lock bar receiving plate.

In FIG. 15, a side perspective view of control arm 44 is shown drawn back to the terminus of straight ahead control point 36 of control plate 30, as shown with movement arrow 84. As the control arm 44 is drawn back, trip plate 64, at the tip of control arm 44, engages trip arm 66, overcomes a spring force of a trip arm spring 62, and rotates trip arm 66, as shown with movement arrow 80. With trip arm 66 rotated and no longer pressing on lifting arm 60, a lock bar 68 lowers under its own weight. When lowered, lock bar 68 will rest on a top edge of the lock bar receiving plate 70. Sloped edges at the top of the lock bar receiving plate 70 allow a free end of the lock bar 68 to slide along them as the plow 40 is being rotated. When lock bar 68 aligns with a lock bar receiving plate notch 72, the lock bar 68 will fall into the lock bar receiving plate notch 72, thus locking the plow blade 40 in the straight-ahead position.

Figure 16:
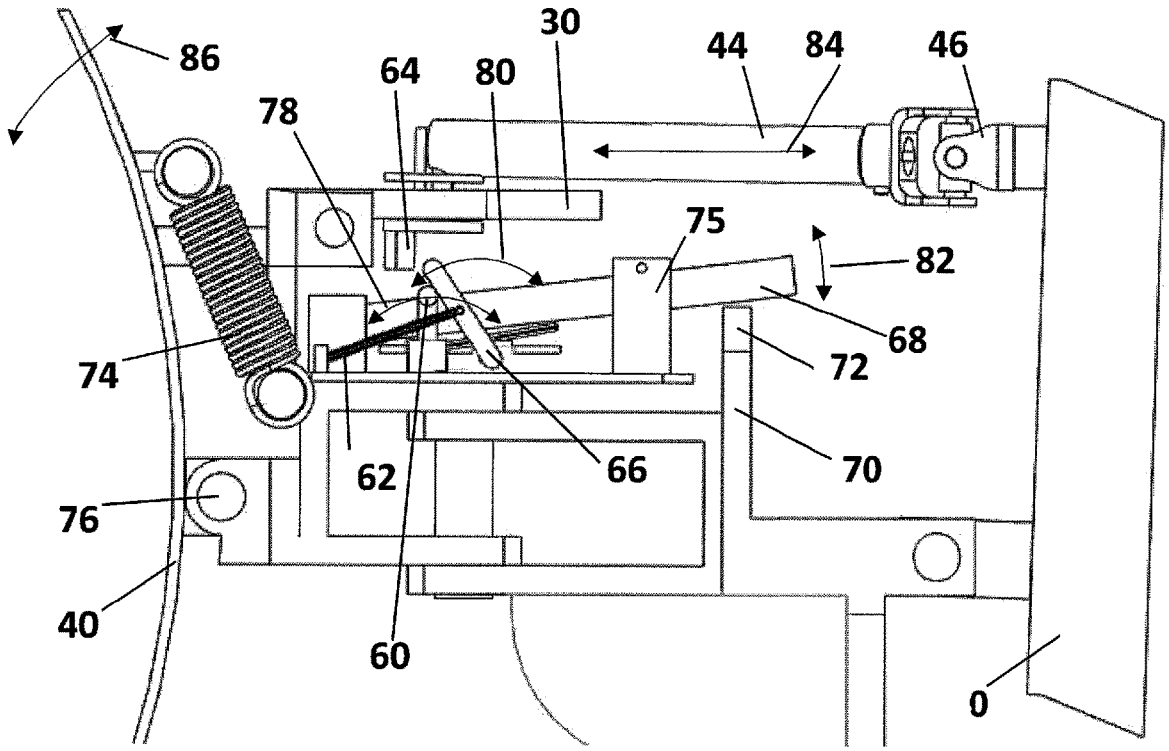
FIG. 16 is a perspective view of the straight ahead plowing position locking mechanism, showing the lock bar disengaged from the lock bar receiving plate.

In FIG. 16, A perspective view of control arm 44 is shown having moved away, see direction arrow 84, from the straight ahead control point 36, by the tilting control plate 30 forward. At this time, the trip plate 64 disengages the trip arm 66, allowing the trip arm spring 62 to pull the trip arm 66 against the lifting arm 60. The lifting arm 60, in turn, raises the lock bar 68 out of the lock bar receiving plate notch 72, freeing the blade 40 to be rotated.

Figure 17:
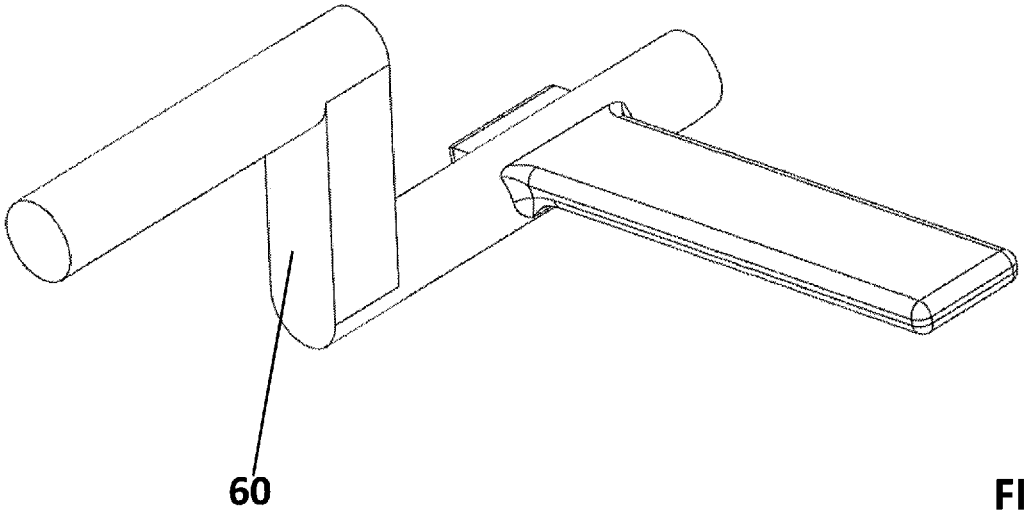
FIG. 17 is a perspective view of the lifting arm for reference only.

In FIG. 17, the lifting arm 60 is shown for clarity.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The invention claimed is:

1. An adjustable snow plow blade mechanism connected to an attachment plate and a snow plow blade, the attachment plate mounted on front of a front end loader (FEL), the FEL mounted on a hydraulically operated tractor, the attachment plate and the snow plow blade are raised and tilted by the FEL, the mechanism comprising:

a lock notch bar adapted for attachment to the attached plate, thus allowing pivotal movement relative to a plow blade frame;

a plurality of lock notches disposed along a length of the lock notch bar;

and a lock bar adapted for pivot attachment to the snow plow blade, one end of the lock bar received in a selected lock notch for securing the snow plow blade in a selected angle position;

whereby, when the attachment plate is rotated forward and tilted, the lock bar is released from the selected lock notch and the snow plow blade is free to rotate to the left or right.

2. The plow blade mechanism as described in claim 1 further including a tail wheel frame, one end of the tail wheel frame attached to a tail wheel, an opposite end of the tail wheel frame pivotally attached to a rear of the snow plow blade.

3. The plow blade mechanism as described in claim 2 wherein the tail wheel frame is attached to a vertical pivot rod mounted on the rear of the snow plow blade.

4. An adjustable snow plow blade mechanism connected to an attachment plate, the attachment plate mounted on front of a front end loader (FEL), the FEL mounted on a hydraulically operated tractor, the attachment plate is raised and tilted by the FEL, the mechanism comprising:

a lock notch bar adapted for attachment to the attached plate, thus allowing pivotal movement relative to a plow blade frame;

a plurality of lock notches disposed along a length of the lock notch bar;

a snow plow blade; and a lock bar pivotly attachment to the snow plow blade, one end of the lock bar received in a selected lock notch for securing the snow plow blade in a selected angle position;

whereby, when the attachment plate is rotated forward and tilted, the lock bar is released from the selected lock notch and the snow plow blade is free to rotate to the left or right.

5. The plow blade mechanism as described in claim 4 further including a tail wheel frame, one end of the tail wheel frame attached to a tail wheel, an opposite end of the tail wheel frame pivotally attached to a rear of the snow plow blade.

6. The plow blade mechanism as described in claim 5 wherein the tail wheel frame is attached to a vertical pivot rod mounted on the rear of the snow plow blade.

7. An adjustable snow plow blade mechanism connected to an attachment plate, the attachment plate mounted on front of a front end loader (FEL), the FEL mounted on a hydraulically operated tractor, the attachment plate is raised and tiled by the FEL, the mechanism comprising:

a lock notch bar adapted for attachment to the attached plate, thus allowing pivotal movement relative to a plow blade frame;

a plurality of lock notches disposed along a length of the lock notch bar;

a snow plow blade;

a lock bar pivotly attachment to the snow plow blade, one end of the lock bar received in a selected lock notch for securing the snow plow blade in a selected angle position;

whereby, when the attachment plate is rotated forward and tilted, the lock bar is released from the selected lock notch and the snow plow blade is free to rotate to the left or right;

and a tail wheel frame, one end of the tail wheel frame attached to a tail wheel, and an opposite end of the tail wheel frame pivotally attached to a rear of the snow plow blade, the tail wheel frame is attached to a vertical pivot rod mounted on the rear of the snow plow blade.

* * * * *